United States Patent [19]

Tokuno

[11] 4,453,436

[45] Jun. 12, 1984

[54] DIE CUTTER AND PROCESS FOR DIE CUTTING

[75] Inventor: Masateru Tokuno, Hyogo, Japan

[73] Assignee: Rengo Co., Ltd., Osaka, Japan

[21] Appl. No.: 296,058

[22] Filed: Aug. 25, 1981

[30] Foreign Application Priority Data

| | | | |
|---|---|---|---|
| Sep. 3, 1980 | [JP] | Japan | 55-123934 |
| Jul. 7, 1981 | [JP] | Japan | 56-107707 |
| Jul. 17, 1981 | [JP] | Japan | 56-114545 |

[51] Int. Cl.[3] ..... B26D 1/40; B26D 5/22

[52] U.S. Cl. ..... 83/76; 83/74; 83/313; 83/324; 83/328

[58] Field of Search ..... 83/38, 74, 76, 311, 83/313, 324, 328

[56] References Cited

U.S. PATENT DOCUMENTS

| | | | |
|---|---|---|---|
| 2,838,947 | 6/1958 | Sarka | 83/313 X |
| 2,963,965 | 12/1960 | Baumgartner | 83/74 X |
| 3,156,150 | 11/1964 | Sarka | 83/313 X |
| 3,203,288 | 8/1965 | Blumer | 83/328 X |
| 3,244,863 | 4/1966 | Paterson | 83/76 X |
| 3,686,987 | 8/1972 | Colinet et al. | 83/328 X |
| 4,283,975 | 8/1981 | Knoll | 83/324 X |

*Primary Examiner*—James M. Meister

*Attorney, Agent, or Firm*—Wenderoth, Lind & Ponack

[57] ABSTRACT

Die cutter and process for die cutting blanks by a blade unit and an anvil opposed to each other are proposed in which either the blank feed speed or the horizontal component of speed of the blade and the anvil is controlled mechanically or electronically to make them equal to each other during the cutting operation.

2 Claims, 17 Drawing Figures

DIE CUTTER AND PROCESS FOR DIE CUTTING

The present invention relates to a process and apparatus for die cutting blanks of corrugated fiberboard, cardboard, metal, plastic material or the like into a desired shape.

Two types of die cutters are known, i.e. the rotary type for continuous die cutting and the flat plate type for intermittent die cutting. The former provides high productivity because of continuous operation, but has a poor cutting accuracy due to slippage between the blank and the cutter. Further, it is complicated and expensive to mount blades on a rotary blade. The latter provides high cutting accuracy and easy blade mounting on a flat plate. However, the productivity is low because of intermittent operation and the blade is liable to be marred because of large cutting resistance.

A die cutter is known (e.g. from Japanese patent publication No. 56-16039) which uses a flat plate type blade but die-cuts the blanks continuously. The operation of this known die cutter is schematically illustrated in FIGS. 1A to 1C. A flat plate shaped blade unit 1 comprising a blade and a blade mount is opposed to a flat plate shaped anvil 2 with the blank B running therebetween. They have their front ends pivotally supported on driving links 4 and 5 and have their rear ends pivotally and slidably supported on driven links 4' and 5'. The upper surface of the anvil 2 facing the blade unit 1 is slightly convex.

As shown in FIG. 1B, the link 4 for the blade unit 1 lags by an angle $\theta$ relative to a vertical line l whereas the link 4' leads by the same angle. This is true for the links 5 and 5' for the anvil 2, as well. When the links 4 and 4' are rotated the same way in one direction and the links 5 and 5' are rotated in the other direction, all at the same angular speed, the contact point between the blade unit and the anvil will shift from one end to the other as shown in FIGS. 1A to 1C. Therefore, a cutting unit comprised of the blade unit 1 and the anvil 2 die-cuts the blanks into a desired shape during one cycle of its operation.

If the links 4 and 5 lead whereas the links 4' and 5' lag, the contact point will shift in a reverse direction to above. Also, the blade unit 1 and the anvil 2 may have their front ends pivotally and slidably supported on the driven links 4 and 5 and their rear ends pivotally supported on the driving links 4' and 5'. Thus, a total of four combinations are possible according to which links are adapted to lead and which links are driving. In any of the combinations, the cutting unit can cut one blank during its own cycle of operation.

With such a known die cutter, the cutting accuracy is not entirely satisfactory. This results from the fact that because the angular speed of the links 4 and 5 at the driving side is constant, the horizontal component $V_1$, $V_2$ and $V_3$ of the peripheral speed of the links varies as shown in FIG. 2. The curve S shows that, as is known, the horizontal component varies substantially according to the cosine curve. This is true for the blade unit 1 and the anvil 2 whereas the blank speed is constant. Thus, the horizontal component of the speed of the blade unit 1 and the anvil 2 does not coincide with the blank speed. If the radius of rotation of the links is large or the blanks are thin, the difference in these two speeds does not cause a problem. However, otherwise the cutting accuracy is not necessarily satisfactory.

An object of the present invention is to provide process and apparatus for die cutting blanks with the horizontal component of speed of the cutting elements, e.g. the blade and the anvil, synchronized with the blank feed speed or vice versa at least while the blank is engaged by the blade and the anvil for cutting.

According to one aspect of the present invention there is provided a process and apparatus for die cutting blanks wherein the cutting unit and the blank feed unit are driven from a common drive unit, but the latter being driven through a non-uniform speed transmission means.

According to another aspect of the present invention there is provided a process and apparatus for die cutting blanks wherein the cutting unit and the blank feed unit are driven from a common drive unit, but the former being driven through a non-uniform speed transmission means.

According to still another aspect of the present invention there is provided a process and apparatus for die cutting blanks wherein an electronic control circuit is provided for controlling the drive unit for the blank feed unit in relation to the drive unit for the cutting unit driven at a constant speed.

According to a further aspect of the present invention there is provided a process and apparatus for die cutting blanks wherein an electronic control circuit is provided for controlling the drive unit for the cutting unit in relation to the drive unit for the blank feed unit driven at a constant speed.

Other features and advantages of the present invention will become apparent from the following description taken with reference to the accompanying drawings, in which.

Figure 4:
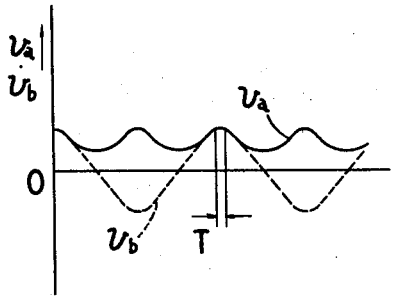
FIG. 4 is a graph showing the relationship between two speeds in the first embodiment.
Figure 3:
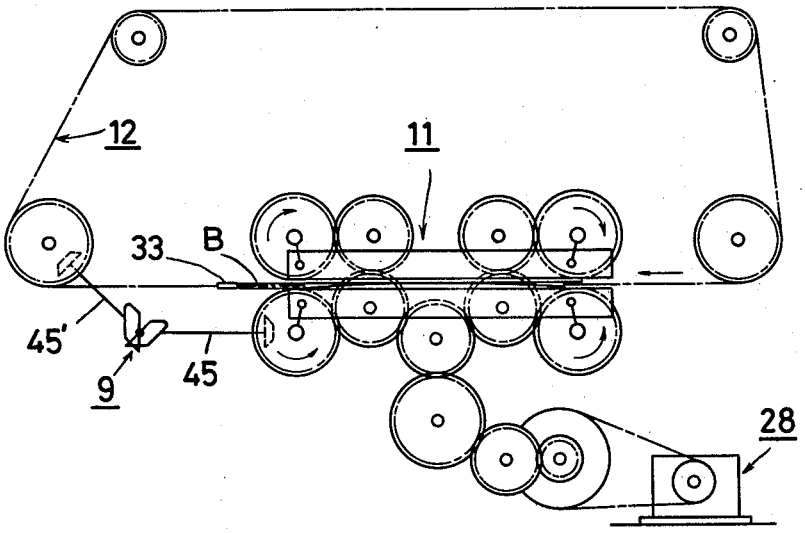
FIG. 3 is a view showing a basic concept of the first embodiment.

FIG. 3 is a schematic diagram showing a basic concept of the first embodiment in which the cutting unit 11 and the blank feed unit 12 are driven by a common drive unit 28, but a non-uniform speed transmission means 9 is interposed between these two units to bring the blank feed speed into accord with the horizontal component of the speed of the cutting elements at least during the cutting operation. By the term "non-uniform speed transmission means" is meant any device which transmits a uniform-speed rotation of its input shaft 45 to an output shaft 45' the speed of which varies in a curve approximate to a sine curve. It includes e.g. non-uniform speed type universal joints, Oldham's couplings and elliptical gear mechanisms. With such a non-uniform transmission means, the blank feed speed Va will be as shown in FIG. 4 as indicated by a solid line whereas the horizontal component Vb of the cutting elements varies on the cosine curve as described above. It is only for a short period of time T at a crest of the cosine curve that the blade actually engages the anvil for cutting. Therefore, the blank speed Va has to be equal to the horizontal component of speed of the cutting elements only for the period T. In other words, any device which can give the blank feed unit such a speed output periodically can be used as the non-uniform transmission means.

Although in this embodiment the non-uniform transmission means is provided between the cutting unit and the blank feed unit, it may be provided between the drive unit 28 and the blank feed unit.

Although in FIG. 4 the blank speed Va becomes equal to the horizontal component Vb at every other crest of the curve, they can be made equal at a desired pitch by suitably selecting the transmission ratio between the drive unit 28 and the cutting unit 11 or between the cutting unit and the blank feed unit.

The first embodiment will be described in more detail with reference to FIGS. 5 to 10. In the following description, the word "front" refers to the blank discharge side (left on FIG. 5) and the word "rear" refers to the blank supply side (right on FIG. 5).

Figure 5:
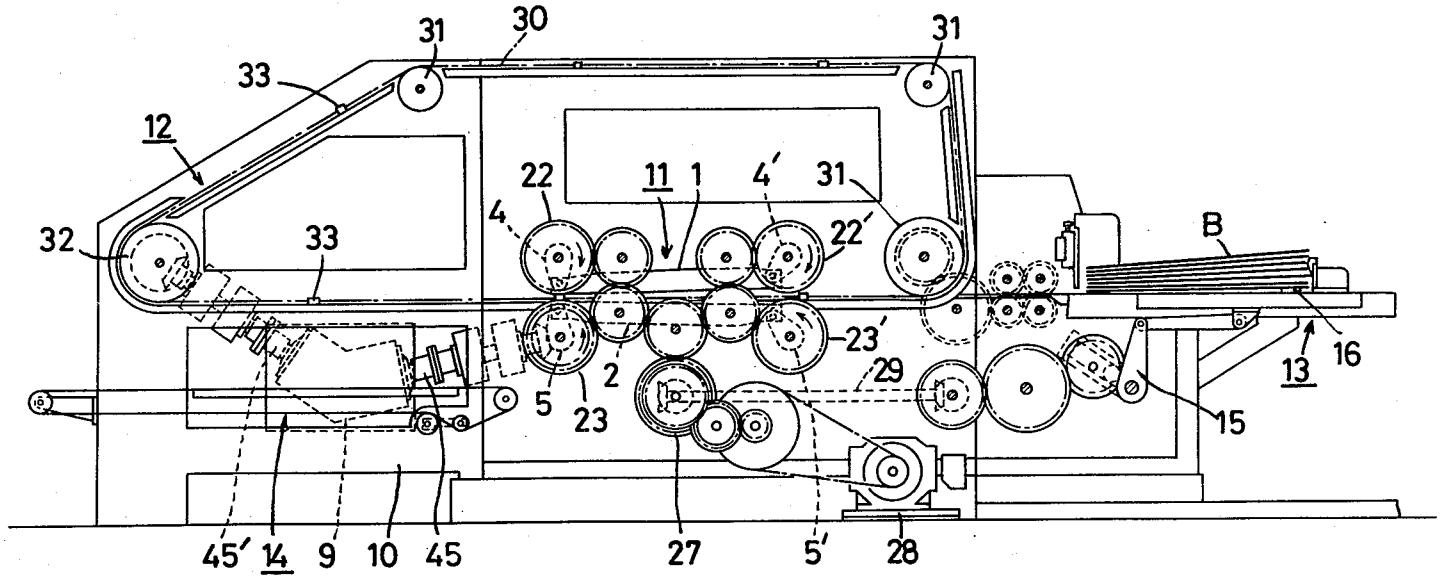
FIG. 5 is a vertical sectional view of the entire apparatus of the first embodiment.

FIG. 5 illustrates an entire die cutter of the first embodiment according to the present invention which includes a frame 10, a cutting unit 11, a blank feed unit 12, a blank supply unit 13, a blank discharge unit 14, a non-uniform transmission means 9, and a drive unit 28.

The blank supply unit 13 provided behind the cutting unit 11 has a kicker 16 adapted to reciprocate by means of a crank arm 15. It operates in synchronization with the blank feed unit to feed blanks B thereto intermittently one after another. This blank discharge unit 14 comprises a belt conveyor provided in front of the cutting unit 11 to discharge the die-cut blanks which fall onto the belt conveyor.

The cutting unit 11 includes a blade unit 1 shaped like a flat plate and an anvil 2 of a similar shape opposed thereto with the blanks running therebetween. The blade unit and the anvil have their front and rear ends pivotally supported on links 4, 4' and 5, 5', respectively. This is the same as the known arrangement described above.

Figure 6:
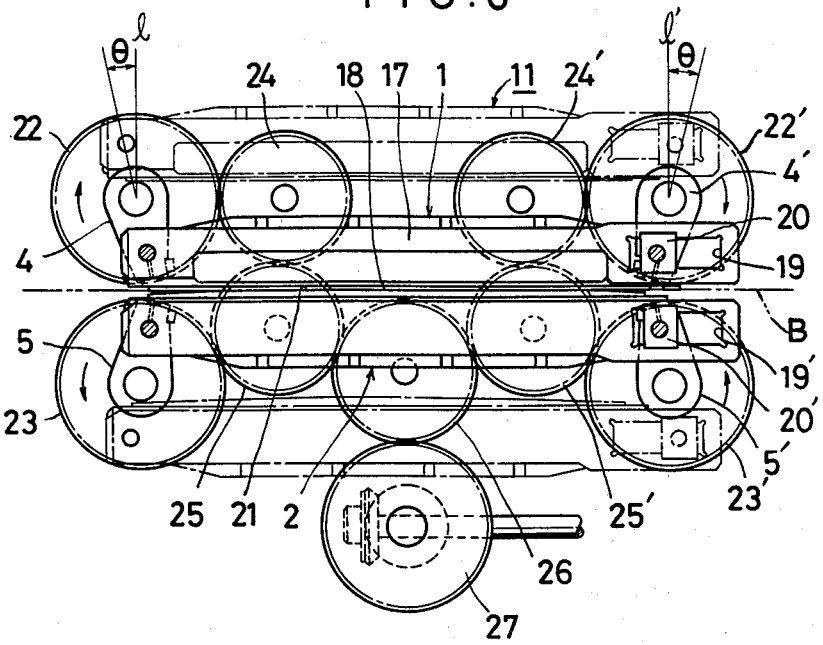
FIG. 6 is a vertical sectional side view of the cutting unit.

As will be seen from FIG. 6, the blade unit 1 has a flat blade mount 17 and a blade 18 removably mounted on its underside. The blade mount is provided with a guide slot 19 at its rear end of each side to receive a slider 20 therein. The rear link 4' is pivotally mounted on the slider 20. The anvil 2 has a shape similar to the blade unit with a guide slot 19' receiving a slider 20'. Its upper surface 21 facing to the blade unit is slightly convex.

The links 4, 4', 5 and 5' have the same radius of rotation and are fixedly mounted on the shafts of gears 22, 22', 23 and 23', respectively, which have the same diameter and the same number of teeth and are driven through idle gears 24, 24', 25, 25' and 26 by a driving gear 27. Thus, the links 4 and 4' of the blade unit turn the same way in one direction and the links 5 and 5' for the anvil turn in the reverse direction.

In the condition shown in FIG. 6, the front link 4 of the blade unit lags by an angle $\theta$ relative to the reference line l whereas the rear link 4' leads by the same angle. Thus, there is a phase difference of $2\theta$ between the links 4 and 4'. The phase difference between the links 5 and 5' for the anvil is symmetrical to that between the links 4 and 4' for the blade unit.

Since the blade unit 1 and the anvil 2 are driven by the links 4, 4', 5 and 5' arranged as described above and the anvil has a convex upper surface 21, the blade unit and the anvil will turn with the blade 18 contacting the convex surface 21 at a point, said contact point moving from one end to the other end (from rear to front in the preferred embodiment). As a result, the blanks B are die cut into a desired shape. The blade 18 may be provided to extend for almost the whole length of the blade mount 17 (as shown) or for only part thereof.

Figure 7:
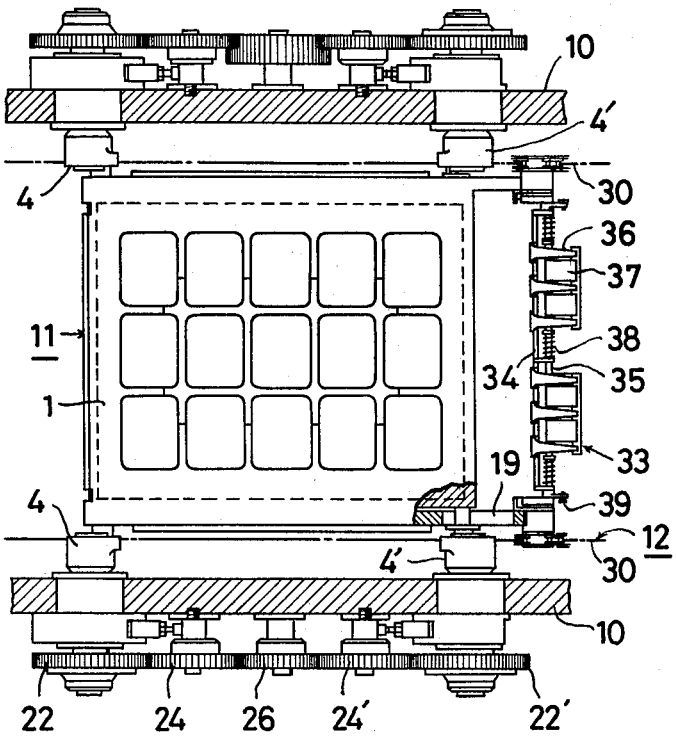
FIG. 7 is a plan view of the same.

Next, the blank feed unit 12 will be described. It has two endless chains 30 running inside of the frame 10 (FIG. 7) around a plurality of guide sprockets 31 and a drive sprocket 32 (FIG. 5). Blank grip units 33 are provided which extend between the two chains 30 at intervals (FIGS. 5 and 7).

Each grip unit 33 includes a fixed bar 34 with grip pieces 36 and rotatable bar 35 with grip supports 37. The bar 35 is normally biassed by springs 38 in such a direction that the grip supports 37 will be pressed against the grip pieces 36. The rotatable bar is provided with cam rollers 39.

Figure 8:
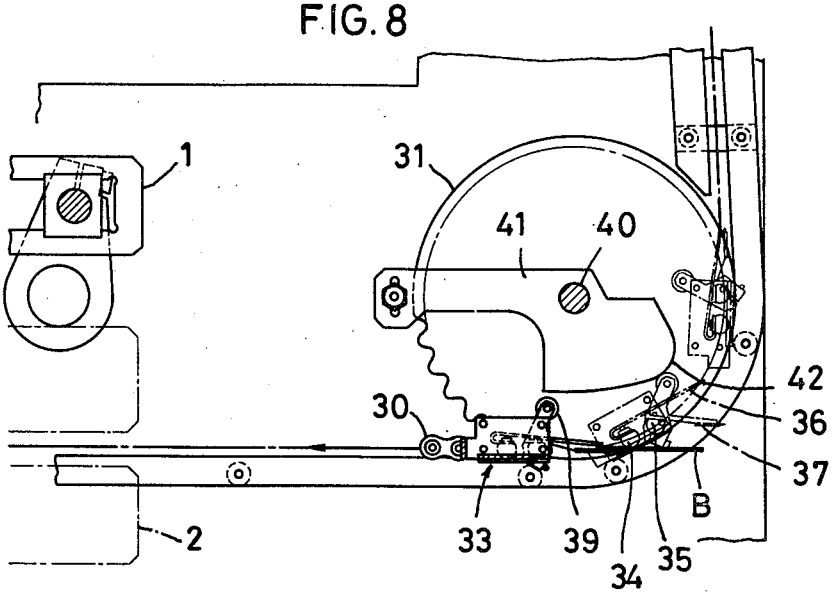
FIG. 8 is a side view of a portion of the blank feed unit showing the blank grip mechanism.

Referring to FIG. 8 showing mechanism for clamping the blanks supplied from the blank supply unit 13, a cam plate 41 having a curved surface 42 is mounted on the shaft 40 of the guide sprocket 31 at each side at an adjustable angle. When the cam roller 39 is engaged by the curved surface 42, the bar 35 will turn, pushing the grip piece 36 up away from the grip support 37 into position shown in FIG. 8 by dotted line. The blank B is supplied into open space between the grip piece 36 and the grip support 37. When the cam roller 39 comes off the curved surface 42, the bar return springs 38 cause the bar 35 to turn in a reverse direction back to its original position so that the blank will be clamped between the two pieces 36 and 37.

Figure 9:
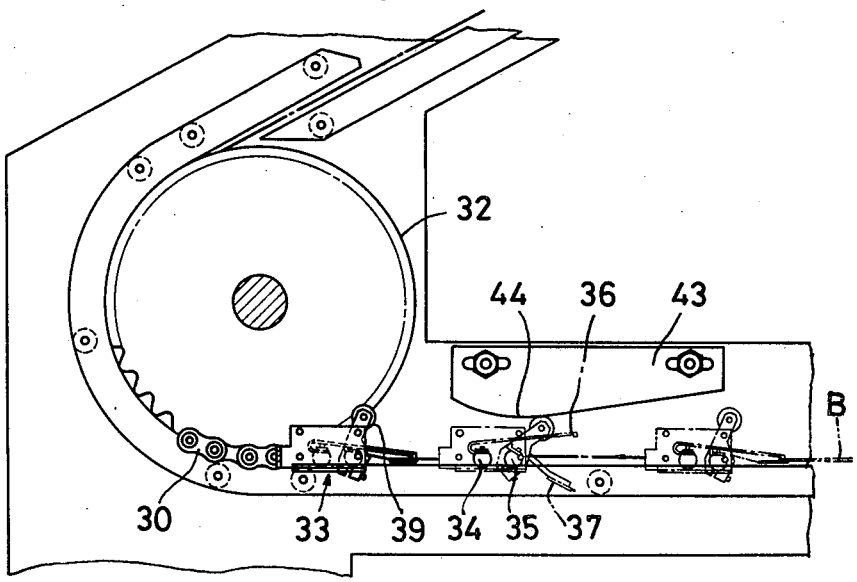
FIG. 9 is a side view of another portion of the blank feed unit showing the blank release mechanism.

Referring to FIG. 9 showing a mechanism for releasing the blanks from the grip unit 33, a cam plate 43 having a curved surface 44 is provided at rear of the drive sprocket 32. When the cam rollers 39 are engaged by the curved surface 44, the grip piece 36 will be opened away from the grip support 37, letting the blank B to fall on to the blank discharge unit 14.

The cutting unit 11, the blank feed unit 12 and the blank supply unit 13 are driven from a common drive unit 28 (FIG. 5) through chain and gear transmission and a transmission shaft 29 so as to synchronize the blank supply, blank feed, and cutting with one another.

Between the gear 23 of the cutting unit 11 and the drive sprocket 32 of the blank feed unit 12, a non-uniform transmission means 9 is provided. The cutting unit is driven at a given transmission ratio from the drive unit 28 through a gear train. By bringing the period of the blank feed speed Va into accord with that of the horizontal component Vb of the cutting unit, Va can be made equal to Vb at least for times T during which the cutting is performed, as will be seen in FIG. 4.

Figure 10:
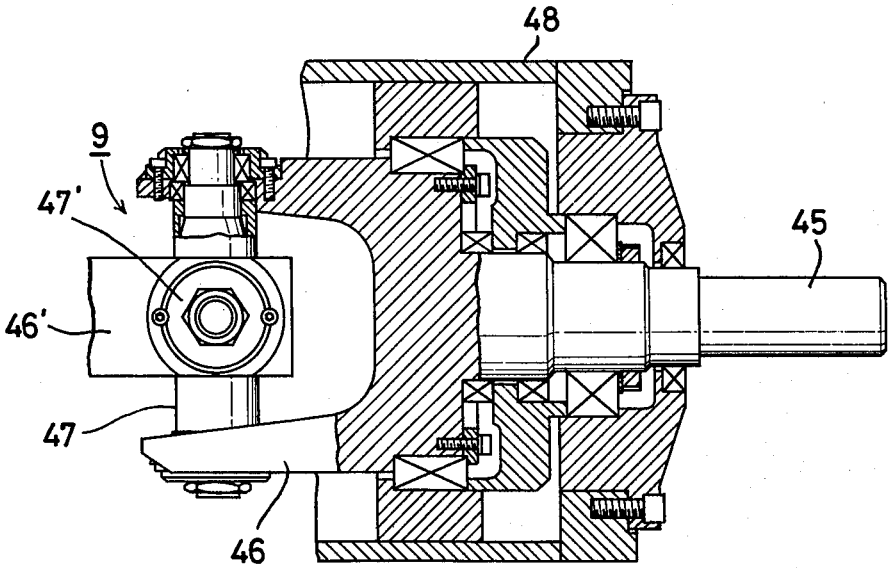
FIG. 10 is a partial sectional view of an example of the non-uniform speed transmission means.

FIG. 10 shows a non-uniform type Hooke or cross coupling as an example of the non-uniform transmission means. It has a casing 48, a driving shaft 45, a U-shaped portion 46 formed at the end of the shaft 45, and a transmission shaft 47 rotatably connected to the U-shaped portion. The coupling has another set of the same arrangement as described above at its output side, the transmission shafts 47 and 47' being coupled crosswisely to each other. The driving shaft 45 and driven shaft 45' and the U-shaped portions 46 and 46' are rotatably mounted in the casing 48 which is to be secured to the machine frame. If the angle of the output shaft 45' to the input shaft 45 is set suitably (FIG. 5), the output shaft will carry out a non-uniform motion at a speed varying in a curve approximate to a sine curve when the input shaft 45 is rotating at a constant speed, so that the blank speed Va can periodically be made equal to the horizontal component Vb of the cutting unit.

Figure 11:
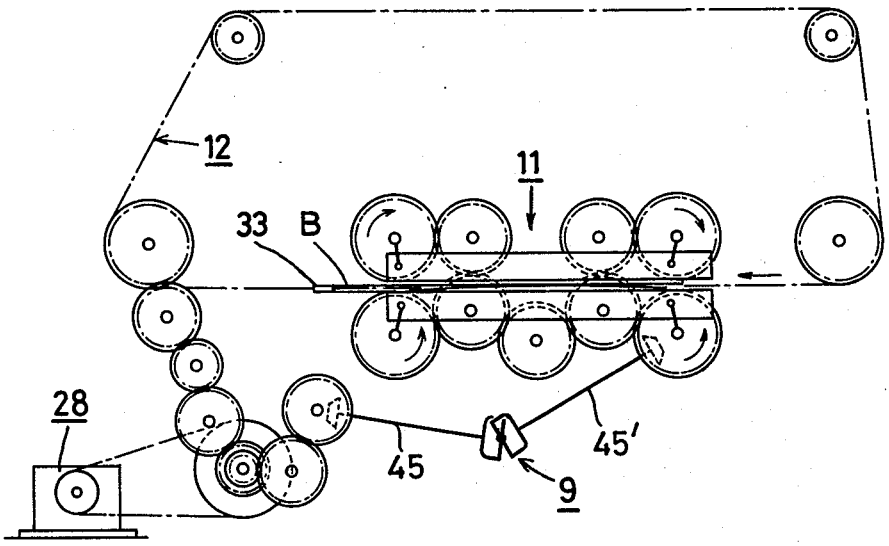
FIG. 11 is a view showing a basic concept of the second embodiment.

Next, the second embodiment will be described below. FIG. 11 shows the basic concept of the second embodiment in which the cutting unit 11 and the blank feed unit 12 are driven by a common drive unit 28, but the former being driven therefrom through a non-uniform transmission means to bring the horizontal component of speed of the cutting elements into accord with the blank feed speed. The non-uniform transmission means used may be the same as described for the first embodiment.

Figure 1A:
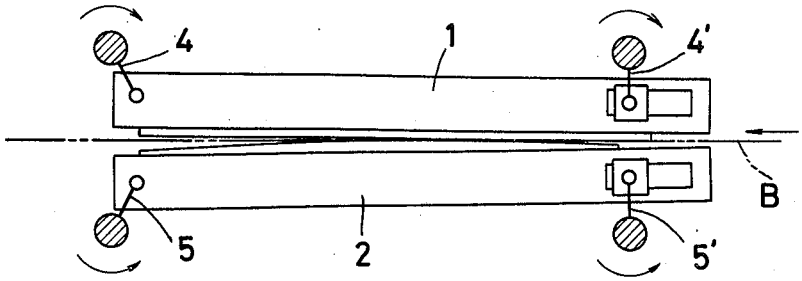
FIG.1A PRIOR ART
FIGS. 1A to 1C are schematic views showing how the conventional die cutter operates.
Figure 1B:
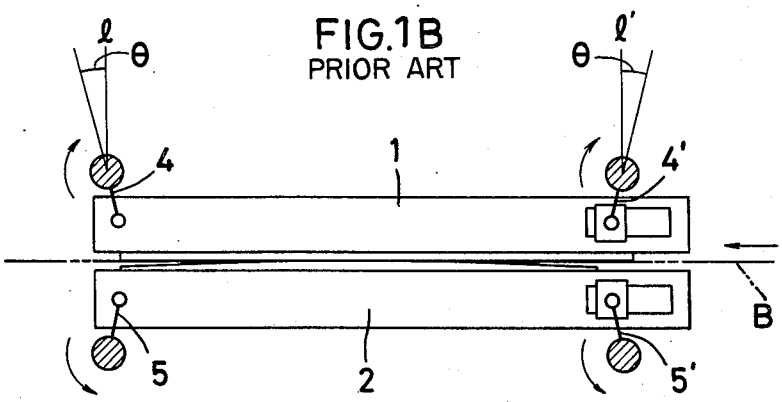
FIG.1B PRIOR ART
Figure 1C:
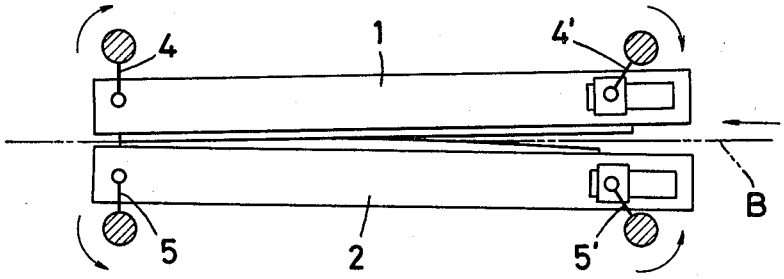
FIG.1C PRIOR ART
Figure 2:
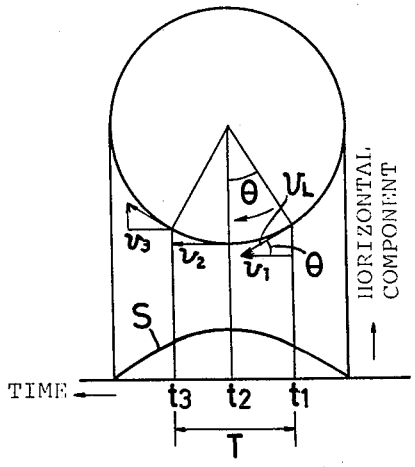
FIG. 2 PRIOR ART
FIG. 2 is a diagram showing the speed vector of the link.
Figure 12:
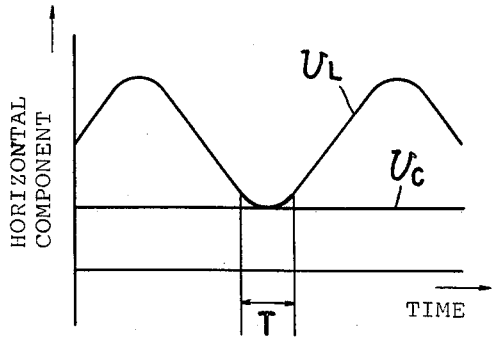
FIG. 12 is a graph showing the relationship between two speeds in the second embodiment.

By the use of such a non-uniform speed transmission means 9, the horizontal component of speed of the cutting elements will be substantially equal to the blank feed speed for the following reason. The peripheral speed $V_L$ of the links 4, 4', 5 and 5' driven through the non-uniform transmission means will vary in a curve approximate to the sine curve as shown in FIG. 12. On the other hand, its horizontal component Vh can be expressed by equation:

$$Vh = V_L \cos \theta$$

as will be seen from FIG. 2. Therefore, the intended purpose can be achieved by setting the peripheral speed $V_L$ so that the horizontal component Vh will be equal to the blank feed speed Vc at least for some period of time T. In this invention, the setting of speed $V_L$ is performed in the non-uniform transmission means. In the graph in FIG. 12, the die cutter may be adapted to perform cutting not at the valley of every cycle of the curve, but at any desired pitch, e.g. at every other valley by suitably selecting the transmission ratio between the drive unit and the cutting unit or between the drive unit and the blank feed unit.

In the second embodiment, the cutting unit, blank feed unit, blank supply unit, blank grip and release mechanism, etc. are the same as those used in the first embodiment, and FIGS. 6, 7, 8, 9 and 10 apply to this embodiment, too, except that in FIG. 6 there is no gear 27 in the second embodiment. In this embodiment, too, the cutting unit, the blank feed unit and the blank supply unit are all driven from a common drive unit 28 for synchronized operation, but, as described above, the non-uniform transmission means is interposed between the drive unit and the cutting unit, instead of between the cutting unit and the blank feed unit as in the first embodiment. The output shaft of the means 9 may be connected e.g. to the gear 23' (FIG. 5). By the interposition of the means 9, the horizontal component of the peripheral speed of the links 4, 4', 5 and 5' can be made equal to the blank feed speed Vc at least during a period of time T while cutting is acually done.

In this embodiment, too, the non-uniform universal joint as shown in FIG. 10 may be used.

Figure 13:
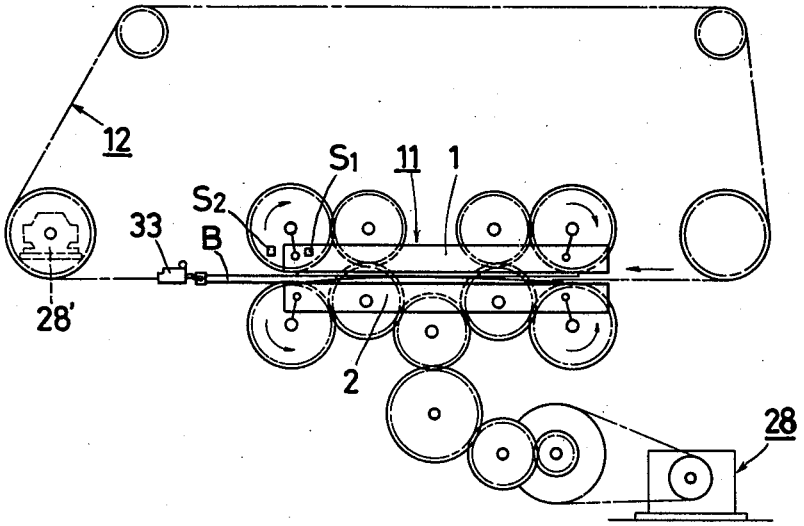
FIG. 13 is a view showing a basic concept of the third and fourth embodiments.

FIG. 13 is a schematic view explaining the basic concept of the third and fourth embodiment of the present invention. In accordance with this invention, either the cutting unit 11 or the blank feed unit 12 is controlled so that the blank feed speed and the horizontal component of speed of the cutting elements will be substantially equal to each other at least during the cutting operation, i.e. from the instant when a cutting start sensor $S_1$ senses position of front link 4 to give a cutting START signal S to the instant when a cutting end sensor $S_2$ senses the position of the link 4 to give a cutting END signal R and so that a grip unit 33 will come to a predetermined position before the cutting unit has completed one cycle of operation.

In the third embodiment, the cutting unit 11 and the blank supply unit 13 are driven from the common drive unit 28 (FIG. 13) through chain and gear transmission and a transmission shaft 29, etc. so as to synchronize the supply of blanks with the cutting. The blank feed unit 12 is driven by a separate drive unit 28'.

The third embodiment will be described with reference to FIG. 14 in which the drive unit 28' for the blank feed unit is controlled in relation to the drive unit 28 for the cutting unit and the blank supply unit.

Figure 14:
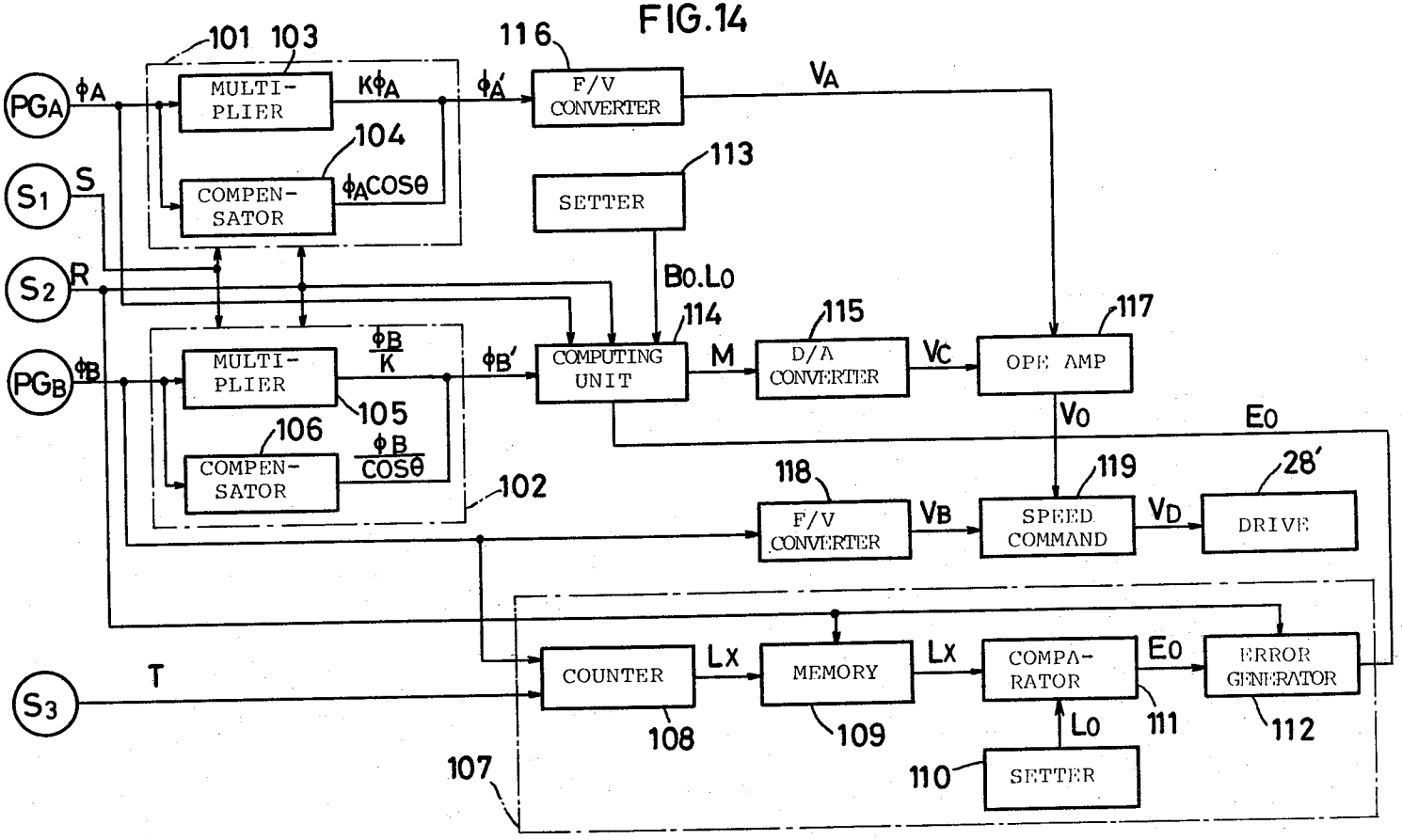
FIG. 14 is a block diagram of the control circuit in the third embodiment.

Referring to FIG. 14, the drive units 28 and 28' are provided with pulse generators $PG_A$ and $PG_B$, respectively, which produce pulse signals $\phi_A$ and $\phi_B$, respectively, proportional to the number of revolutions. Adjacent to the cutting unit 11, a START sensor $S_1$ and an END sensor $S_2$ are provided which sense the start and end of the cutting, respectively, to give a start signal S and an end signal R. Adjacent to the blank feed unit 12 there is provided a grip sensor $S_3$ which senses the grip unit 33 to give a grip detection signal T to check whether it is at the correct position at which it should be located when the end signal R is given. The sensor $S_1$ may be located at a position so as to give a signal either just at the start of cutting or some time before that. Similarly, the sensor $S_2$ may be located at a position so as to give a signal either just at the end of cutting or some time thereafter.

The pulse generators $PG_A$ and $PG_B$ are connected to the first and second compensating circuits 101 and 102, respectively. The former includes a first constant multiplier 103 multiplying the pulse signal $\phi_A$ by a constant K and a first compensator 104 multiplying it by cos $\theta$. The $\theta$ is the angle which the front link 4 at the driving side forms with the vertical line and the constant K is a fixed value equal to cos $\theta$ when the START sensor $S_1$ has given a signal S. The second compensating circuit 102 includes a second constant multiplier 105 dividing the signal $\phi_B$ by the constant K and a second compensator 106 dividing it by cos $\theta$. The first and second compensating circuits 101 and 102 output $\phi_A \cos \theta$ and $\phi B/\cos \theta$, respectively, during the period from the giving of START signal S to that of END signal R, and output $K\phi_A$ and $\phi B/K$, respectively, for the rest of the time. The outputs of the circuits are $\phi_A'$ and $\phi_B'$.

A position compensating circuit 107 compares the position of the grip unit 33 with its predetermined position each time the END signal R is given, and outputs an error signal Eo proportional to the difference therebetween. The error signal Eo will be positive if the grip unit leads the predetermined position and be negative if it lags. The position compensating circuit 107 includes a counter 108 which counts the pulse signal $\phi_B$, a memory 109 which registers the content Lx of the counter 108 in response to the END signal R, a comparator 111 which compares Lx with a reference value Lo from a setter 110 and computes and outputs Eo which is Lx if $Lx<Lo/2$, and $-(Lo-Lx)$ if $Lx\leqq Lo/2$, and an error generator 112 which memorizes the error signal Eo and outputs it in response to the END signal R.

The reference value Lo is a predetermined value proportional to the number of pulses $\phi_B$ generated during the period from the passing of one grip unit 33 to that of the next one. The counter 108 is reset to start counting each time a grip detection signal T is given by the sensor $S_3$. The comparison of Lx with Lo/2 and computation are done to determine how much the grip unit 33 leads or lags from its predetermined position at the instant when the END signal R is given. But, the signal Lx may be compared with any other value, e.g. Lo/3.

In response to the END signal R from the sensor $S_2$, a computing unit 114 reads the values Lo and Bo preset in a setter 113 and the error signal Eo and does a computation $Bo-Lo+Eo-\phi_A+\phi_B'$. The preset value Bo is a fixed value proportional to the number of pulses generated during one cycle of cutting operation (one cycle is e.g. from the end of one cutting to that of the next cutting).

The signal M from the computing unit 114, which is the result of computation, is converted by a D/A converter 115 to an analog error voltage $V_C$. The pulse signal $\phi_A'$ from the first compensating circuit 101 is converted by a frequency/voltage converter 116 to a reference voltage $V_A$ proportional to its frequency. An operational amplifier 117 compares the error voltage $V_C$ with the reference voltage $V_A$ to give a speed reference voltage Vo $(=V_A-V_C)$.

On the other hand, the pulse signal $\phi_B$ from the second pulse generator $PG_B$ is converted by a frequency/voltage converter 118 to a feed speed voltage $V_B$ proportional to its frequency. A speed command unit 119 compares the feed speed voltage $V_B$ with the speed reference voltage Vo and gives a speed command voltage $V_D$ to the drive unit 28' for the blank feed unit so that the drive unit will be driven with the speed reference voltage Vo. If the latter is negative, the speed command unit 119 will cause the drive unit 28' to stop.

How the control circuit functions will be described below. When the END sensor $S_2$ issues an END signal R, the memory 109 reads the content Lx of the counter 108. The signal Lx is compared with the reference value Lo by the comparator 111 and the error generator 112 gives an error signal Eo which is Lx (if $Lx<Lo/2$) or $-(Lo-Lx)$ (if $Lx\geqq Lo/2$). That is to say, the position compensating circuit 107 outputs an error signal Eo in response to the END signal R. The counter 108 is reset to restart the counting of pulse signal $\phi_B$ in response to the signal T from the grip sensor $S_3$.

In response to the END signal R, the computing unit 114 reads the preset values Bo and Lo and the error signal Eo and restarts the computation $Bo-Lo+Eo-\phi_A+\phi_B'$. The result of computation M is converted by the D/A converter 115 to an error voltage $V_C$, which is compared with the reference voltage $V_A$ by the operational amplifier 117 to obtain the speed reference voltage $Vo(=V_A-V_C)$. On the basis of the voltage Vo and the feed speed voltage $V_B$, the speed command unit 119 supplies the drive unit 28' with a speed command voltage $V_D$, which differs according to whether the value M is positive or negative.

(1) When $Bo-Lo+Eo-\phi_A+\phi_B'\leqq 0$

At the coming of the END signal R, the value M and thus the error voltage $V_C$ are negative. Therefore, the speed reference voltage $Vo(=V_A-V_C)$ will be higher than the reference voltage $V_A$ so that the drive unit 28' will be driven at a higher speed than the drive unit 28. This results in the increase of pulse signal $\phi_B'$ at a higher rate than the pulse signal $\phi_A$ and the value M gradually increases and eventually becomes zero.

(2) When $Bo-Lo+Eo-\phi_A+\phi_B'>0$

At the coming of the END signal R, the value M and thus the error voltage $V_C$ are positive. Thus, the voltage Vo will be lower than the reference voltage $V_A$ so that the drive unit 28' will be driven at a lower speed than the drive unit 28. This decreases the pulse signal $\phi_B'$ in comparison with the pulse signal $\phi_A$. Therefore, the value M will decrease gradually and eventually become zero.

The fact that the value M is zero means that the blank feed unit driven by the drive unit 28' is operating in synchronization with the cutting unit 11. If they operate not synchronized with each other for some reason, they will be controlled so as to return to a synchronized state. If the cutting unit 11 runs at a higher speed than the blank feed unit 12, the number of pulse signal $\phi_B'$ will be smaller than that of pulse $\phi_A$. Thus, the value M $(=Bo-Lo+Eo-\phi_A+\phi_B')$ and thus the error voltage $V_C$ will be negative. Therefore, the voltage Vo will be higher by the absolute value of the error voltage $V_C$ than the reference voltage $V_A$ $(Vo=V_A-(-|V_C|)=V_A+|V_C|)$. This means that the blank feed unit 12 is accelerated so that the pulse signal $\phi_B'$ will increase to become greater than the pulse signal $\phi_A$. Thus the value M will be kept at zero. Therefore, the blank feed unit 12 will be brought back to synchronization with the cutting unit 11.

If the cutting unit 11 runs at a lower speed than the blank feed unit 12, the number of pulse signal $\phi_B'$ will be larger than the pulse signal $\phi_A$. Thus the value M and thus the error voltage $V_C$ will be positive. Therefore, Vo will be lower than $V_A$ by the error voltage $V_C$. As a result, the blank feed unit 12 is decelerated so that the pulse signal $\phi_B'$ will decrease to become less than the pulse signal $\phi_A$. Therefore, the value M will be kept at zero and the blank feed unit 12 will be brought back to synchronization with the cutting unit 11.

Comparision with the speed reference voltage Vo of the blank feed speed voltage $V_B$, which is a feedback voltage, is done to check whether or not the drive unit 28' is driving with the voltage Vo.

Under the above-mentioned condition, the constant multipliers 103 and 105 are selected and the drive unit 28' is driven at a speed which is the speed of the drive unit 28 multiplied by the constant K.

When the start sensor $S_1$ gives the START signal S, the first and second compensating circuits 101 and 102 are switched from the constant multipliers 103 and 105 to the compensators 104 and 106, respectively. Thereafter and until the END signal R is given, the blank feed unit is controlled so that the blank speed will be equal to the horizontal component of the speed of the front link 4 in the cutting unit.

When cutting is complete, the end sensor $S_2$ gives the END signal R again and the above-mentioned control cycle is repeated for cutting.

During the time from the end of cutting to the start of the next cutting, the blank feed unit 12 will be controlled on the basis of the above-described computation so as to be kept synchronized with the cutting unit.

The fourth embodiment will be described with reference to FIG. 15 in which the cutting unit is controlled in relation to the blank feed unit driven at a constant speed. The control circuit of FIG. 15 is essentially the same as that of FIG. 14 except that the positions of the first and second compensating circuits 101 and 102 are exchanged, that the F/V converter 116 receives the pulse signal $\phi_B'$, not $\phi_A'$, that the position compensating circuit 107 further includes a third constant multiplier 111*a* giving a signal Bo/Lo to the comparator 111 which outputs an error value $Eo'=Bo/Lo \times Eo$ (Eo is the same as described above), that the computing unit 114 does a computation $Lo-Bo-Eo'+\phi_A'-\phi_B$, that the F/V converter 118 receives the pulse signal $\phi_A$, not $\phi_B$, and that the speed command unit 119 controls the drive unit 28, not 28'.

In the fourth embodiment, the multiplication of Eo by constant Bo/Lo for an error value Eo' is necessary because a number of pulses proportional to the preset value Bo are generated from the cutting unit 11 during one cycle of operation whereas a different number of pulses proportional to the preset value Lo are generated from the blank feed unit 12 during the same cycle.

Figure 15:
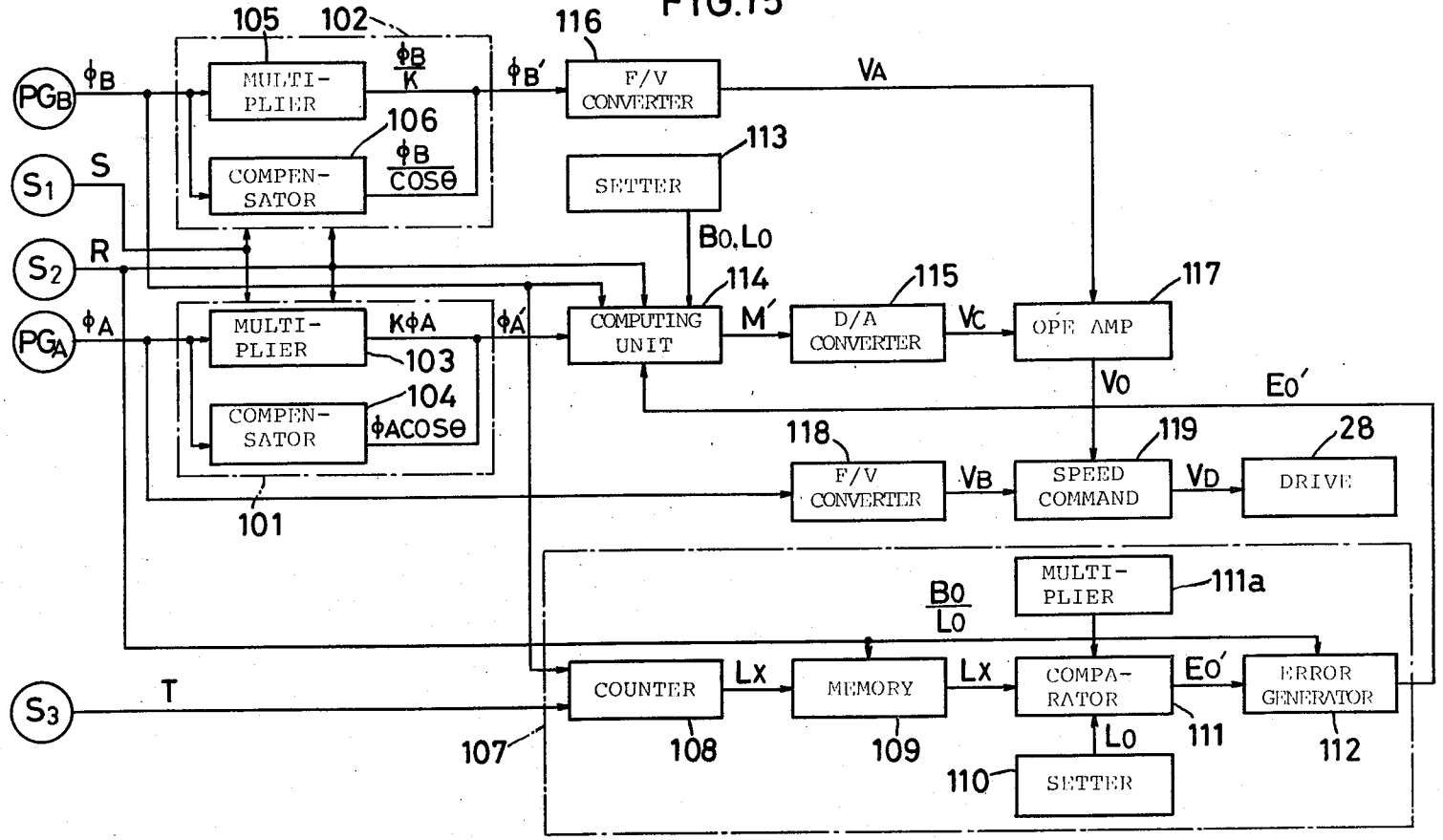
FIG. 15 is a block diagram of the control circuit in the fourth embodiment.

The operation of the control circuit of FIG. 15 is similar to that of the control circuit of FIG. 14.

Although in the third and fourth embodiments compensation is made by use of cos $\theta$ in the compensating circuits 101 and 102, any other value determined experimentally or theoretically may be used. Such a value may not necessarily be an exact one but an approximate one so long as cutting is satisfactory.

Although in these embodiments the computing unit 114 is adapted to read the error value from the compensating circuit 107 in response to the END signal R from the sensor $S_2$, it may be adapted to read it in response to the START signal S from the sensor $S_1$ or any other point of time preferably other than during the cutting.

In the latter case another sensor is required which senses the front link 4 to give a signal in response to which the position compensating circuit 107 gives an error value and simultaneously the computing unit 114 reads it. Further it is necessary to move the grip sensor $S_3$ to such a position when the another sensor and the grip sensor each will give a detection signal at the same time.

Although in these embodiments the position compensating circuit 107 counts the pulse signal $\phi_B$ generated from the blank feed unit 12 to give an error value, it may count the pulse signal $\phi_A$ from the cutting unit 11 for the same purpose. Pulse generators may be mounted not on the shafts of drive motors for the blank feed unit and the cutting unit but on any parts interlocking with these units. Further, the grip sensor $S_3$ may be replaced with a sensor detecting any part or portion which moves for a given distance or makes one turn for a time during which the grip unit 33 advances by one pitch.

It will be understood from the foregoing that the die cutter according to this invention permits accurate cutting because the blank feed speed and the horizontal component of the speed of the cutting elements are adapted to be equal to each other during the cutting operation.

In the third and fourth embodiments, because the grip position is checked each time the cutting END signal is given, blank feed to the cutting unit is very accurate and so the production of defective products due to inaccurate blank positioning is prevented.

What we claim:

1. A die cutter for cutting blanks supplied one after another into a desired shape, said die cutter comprising:

cutting means having a blade and an anvil opposed to each other for cutting blanks running therebetween and link and transmission means for driving said blade and said anvil interlocked with each other in such a manner that they will contact each other at a point moving from one end thereof to the other, said anvil having a convex-shaped upper surface;

blank feed means having a conveyor and blank grip units mounted on said conveyor for feeding blanks through said cutting means;

a first drive means driving said cutting means and a second drive means driving said blank feed means; and speed adjusting means connected to one of said drive means for adjusting the speed of one of said drive means for bringing the blank feed speed and the horizontal component of speed of said blade into accord with each other at least during the cutting operation, said speed adjusting means being constituted by:

a first transducer means for generating pulses $\phi_A$, the number thereof being proportional to the angle through which said first drive means has rotated, a second transducer means for generating pulses $\phi_B$, the number thereof being proportional to the angle through which said second drive means has rotated, a first compensating means connected to said first transducer means for receiving the pulses therefrom and for producing a signal $\phi_A'$ which is, at least during the cutting operation, equal to said pulses from said first transducer means multiplied by a correction value, said correction value being a value such that the blank feed speed and the horizontal component of the speed of the blade and the anvil will be substantially equal to each other, and during the rest of one cycle of operation of said cutting means said signal will be equal to said pulses multiplied by a constant, a second compensating means connected to said second transducer means for receiving the pulses therefrom and for producing a signal $\phi_B'$ which, at least during the cutting operation, is equal to said pulses divided by said correction value and, during the rest of one cycle of operation of said cutting means, is equal to said pulses divided by said constant, a converter means connected to one of said compensating means for converting said signal from said one compensating means to a reference voltage signal $V_A$ proportional to the signal from said one compensating means, a computing means connected to the transducer means corresponding to said one compensating means and to the other of said compensating means for receiving a first predetermined value Lo proportional to the number of pulses generated during a time interval from the passing of one grip unit past a predetermined point to the passing of the next grip unit past said point and a second predetermined value Bo proportional to the number of pulses generated during one cycle of operation of said cutting means as well as the signal from said transducer means corresponding to said one compensating means and the signal from the other of said compensating means and for performing a computation based on the received values and signals to obtain an analog signal Vc proportional to the result of the computation, and a combining means connected to said converter means and to said computing means for combining the signal Vc from said computing means with the reference voltage signal $V_A$ from said converter means for obtaining a control signal proportional to the result of the combining and for supplying said control signal to the drive means corresponding to the other of said compensating means for controlling the driving of said lastmentioned drive means for making the result of said computation zero.

2. A die cutter as claimed in claim 1 further comprising a position compensating means for detecting any error in the position of a grip unit relative to that of said cutting elements for each cycle of operation of said cutting means and generating an error signal proportional to said error, said position compensating means being connected to said computing means for supplying said error signal to said computing means, and said computing means comprises means for including said error signal in the performed computation to change the control signal to eliminate said error.

* * * * *